US011305141B2

(12) United States Patent
Drake

(10) Patent No.: US 11,305,141 B2
(45) Date of Patent: Apr. 19, 2022

(54) HORIZONTAL SIDEWALL WINDOW SPRINKLERS, SYSTEMS AND METHODS OF FIRE PROTECTION

(71) Applicant: Minimax Viking Research & Development GmbH, Bad Oldesloe (DE)

(72) Inventor: Jonathan D. Drake, Caledonia, MI (US)

(73) Assignee: Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 16/757,213

(22) PCT Filed: Dec. 15, 2019

(86) PCT No.: PCT/US2019/066423
§ 371 (c)(1),
(2) Date: Apr. 17, 2020

(87) PCT Pub. No.: WO2020/180382
PCT Pub. Date: Sep. 10, 2020

(65) Prior Publication Data
US 2021/0260422 A1 Aug. 26, 2021

Related U.S. Application Data

(60) Provisional application No. 62/814,039, filed on Mar. 5, 2019.

(51) Int. Cl.
*A62C 31/02* (2006.01)
*B05B 1/26* (2006.01)

(52) U.S. Cl.
CPC ..... *A62C 31/02* (2013.01); *B05B 1/265* (2013.01)

(58) Field of Classification Search
CPC ..... A62C 31/02; B05B 1/262; B05B 1/265; B05B 1/267
USPC ..... 169/16, 37; 239/498, 504
See application file for complete search history.

(56) References Cited

U.S. PATENT DOCUMENTS

| | | | |
|---|---|---|---|
| 4,296,816 | A | 10/1981 | Fischer |
| 4,570,720 | A | 2/1986 | Retzloff et al. |
| 4,901,799 | A | 2/1990 | Pepi et al. |
| 5,628,367 | A | 5/1997 | Truax et al. |
| 5,727,737 | A | 3/1998 | Bosio et al. |
| 5,865,256 | A | 2/1999 | Pounder |
| 6,098,718 | A | 8/2000 | Sato |
| 6,167,971 | B1 | 1/2001 | Van Lingen |

(Continued)

OTHER PUBLICATIONS

International Searching Authority, International Search Report and Written Opinion in International Appln. No. PCT/US2019/066423, dated Mar. 5, 2020, 20 pages.

(Continued)

*Primary Examiner* — Steven J Ganey
(74) *Attorney, Agent, or Firm* — Perkins Coie LLP

(57) ABSTRACT

Horizontal window fire protection sprinklers, systems and methods are provided. The sprinklers include a frame and a fluid deflection member including a window confronting surface having a planar portion and a concave portion. The sprinkler defines a maximum operating pressure of at least 100 psi. per sprinkler for adjacent sprinklers without cold soldering.

17 Claims, 7 Drawing Sheets

(56) References Cited

U.S. PATENT DOCUMENTS

| | | | | |
|---|---|---|---|---|
| 6,889,774 | B2 * | 5/2005 | Multer | A62C 37/12 169/37 |
| 7,137,455 | B2 * | 11/2006 | Green | A62C 31/02 169/37 |
| 8,151,897 | B1 | 4/2012 | Meyer et al. | |
| 2003/0160111 | A1 | 8/2003 | Multer et al. | |
| 2003/0201341 | A1 | 10/2003 | Wancho et al. | |
| 2007/0246231 | A1 | 10/2007 | Pahila et al. | |
| 2014/0174765 | A1 | 6/2014 | Miller et al. | |
| 2014/0216769 | A1 | 8/2014 | Almeida et al. | |
| 2017/0216642 | A1 | 8/2017 | Polan et al. | |
| 2021/0308699 | A1 | 10/2021 | Drake | |

OTHER PUBLICATIONS

Globe Sprinkler Company, Datasheet, Window Sprinkler Model WS, Series GL-SS/WS, GFS-640 (Formerly I-5), Dec. 2017, 2 pages.

Peter J. Arsenault, FAIA, NCARB, Leed AP, "Window Sprinklers as an Alternative to Fire-Rated Glass", Continuing Education, Mar. 2018, 12 pages.

Tyco Fire Protection Products, Datasheet, Model WS Specific Application Window Sprinklers Horizontal and Pendent Vertical Sidewall 5.6K Factor, TFP620, Oct. 2016, 10 pages.

Reliable Automatic Sprinkler Co., Model B Model FM Spray Nozzles, Bulletin 103 Rev. B, Oct. 2012, 2 pages.

Reliable Automatic Sprinkler Co., Model B Model FM Spray Nozzle, Distribution Patterns, Date Unknown, 1 page.

The Viking Corporation, Technical Data, Model C-1 Window Sprinklers, Form No. F_051800, Dec. 20, 2013, 6 pages.

* cited by examiner

HORIZONTAL SIDEWALL WINDOW SPRINKLERS, SYSTEMS AND METHODS OF FIRE PROTECTION

PRIORITY CLAIM & INCORPORATION BY REFERENCE

This application is a 35 U.S.C. § 371 application of International Application No. PCT/US2019/066423, filed Dec. 15, 2019, which claims the benefit of U.S. Provisional Application No. 62/814,039 filed Mar. 5, 2019, each of which is incorporated by reference in its entirety.

TECHNICAL FIELD

The present invention relates generally to sprinklers and systems for the protection of windows. In particular, the present invention relates to horizontal sidewall sprinklers and their system installation to protect multiple glass panes joined together forming a window arrangement.

BACKGROUND ART

The design and installation of fire protection sprinkler systems is dependent upon several factors including: the area to be protected, the occupants or items to be protected in the area being protected, the manner in which a fire is to be addressed. One particular area of interest is fire protection systems for the use on and protection of windows. Fire protection sprinklers are generally subject to industry accepted fire code requirements and the approval of the "authority having jurisdiction" (AHJ) to ensure compliance with the applicable codes and requirements. For example, one applicable standard is "NFPA 13: Standard for the installation of Sprinkler Systems" (2016) ("NFPA 13") from the National Fire Protection Association (NFPA). NFPA 13 provides minimum requirements for the design and installation of fire protection sprinkler systems based upon the area to be protected, the anticipated hazard and the type of protection performance to be provided.

One manner of satisfying the applicable requirements, is by identification of fire protection sprinklers capable of providing water on the surface of a window in a suitable manner. To facilitate the AHJ approval process, fire protection equipment can be "listed," which as defined by NFPA 13, means that the equipment is included in a list by an organization that is acceptable to the AHJ and whose list states that the equipment "meets appropriate designated standards or has been tested and found suitable for a specified purpose." One such listing organization includes, Underwriters Laboratories Inc. ("UL"), which publishes UL Standard for Safety for Automatic Sprinklers for Fire-Protection Service UL 199 (11th ed. 2005, rev. 2008) ("UL 199") and UL Standard 199J: "Outline of Investigation for Fire Testing of Specific Application Sprinklers for Use on Windows" Issue No. 2 (Jul. 17, 2017) to provide various operational testing for fire protection sprinklers. Another listing organization is Underwriters' Laboratories of Canada (ULC) which publishes ULC/ORD-C263,1-99 "Sprinkler-Protected Window Systems" that provides the testing performance requirements to assess performance, under controlled the exposure conditions, of a sprinkler protected window system.

Known sprinkler systems for protection of a window arrangements include sprinklers that are positioned to wet and cool the glass panes of the window arrangement. A window arrangement generally includes glass panes affixed between an upper window frame and a lower window frame. In arrangements having multiple glass panes, the glass panes may be separated from one another by vertical barriers or mullions that extend between the upper and lower window frames. Alternatively, the individual glass panes can abut one another in a butt joint formation. Fire protection sprinklers for the protection of windows can be automatic or non-automatic. Generally, automatic fire protection sprinklers include a solid metal body and some type of fluid deflector or deflecting member to distribute fluid supplied to and discharged from the body in a defined spray distribution pattern. Fluid discharge from an automatic fire protection sprinkler is automatically controlled by operation of a heat-responsive actuator or trigger that maintains a fluid tight seal at the discharge orifice by exertion of pressure on a cap (button or disc) or other sealing assembly. When the temperature surrounding the sprinkler is elevated to a pre-selected value indicative of a fire, the actuator operates thereby permitting ejection and release of the cap by the discharge of the supplied fluid through the unsealed sprinkler. In the case of non-automatic sprinklers used in manual or automatic deluge systems, there is neither heat-responsive actuator or trigger nor is there a sealing assembly. Instead the non-automatic sprinkler is always open to discharge fluid upon fluid delivery from a fluid supply that is controlled and initiated either manually or through an automatic fluid control system.

Automatic sprinklers can be characterized by: its discharge characteristics, its installation orientation (pendent, upright or sidewall), and its fluid distribution and coverage. The discharge or flow characteristics from the sprinkler body is defined by the internal geometry of the sprinkler including its internal passageway, fluid inlet and discharge outlet (the orifice). As is known in the art, the K-factor of a sprinkler is defined as $K=Q/P^{1/2}$, where Q represents the flow rate (in gallons/min GPM) of water from the outlet of the internal passage through the sprinkler body and P represents the pressure (in pounds per square inch (psi.)) of water or firefighting fluid fed into the inlet end of the internal passageway though the sprinkler body. The spray pattern or distribution of a firefighting fluid from a sprinkler defines sprinkler performance. Several factors can influence the water distribution patterns of a sprinkler including, for example, the shape of the sprinkler frame, the sprinkler orifice size or discharge coefficient (K-factor), the installation orientation and the geometry of the deflector.

The known window fire protection sprinklers include a circular fluid deflecting member of uniform thickness for distributing water over the glass panes. More particularly, the known fluid deflecting member is defined by a peripheral edge of a constant radius circumscribing a continuous planar impact surface that confronts the discharge outlet of the sprinkler body. Accordingly, the known fluid deflecting member does not present any discontinuities in the form of slots, through holes or channels. The sprinklers are installed and coupled to a fluid supply pipe in a manner that orients the fluid deflecting member to confront the glass pane below the upper window frame with a circular continuous planar surface opposite the impact surface. In the known system, the sprinklers are located at a distance of four inches to twelve inches (4-12 in.) from the glass panes. Moreover, the known sprinklers are spaced from one another at a sprinkler-to-sprinkler spacing that can extend up to a maximum of eight feet (8 ft.). At the installation spacings, the sprinklers require a minimum supply of fluid flow that ranges from 15-20 gallons per minute (GPM). For window arrangements without vertical barriers, the known sprinklers have a maximum fluid operating pressure that is limited to 70 pounds per square inch (psi.) in order to prevent "cold soldering" between adjacent sprinklers. As used herein, "cold soldering" is a condition in which the spray from one operating sprinkler onto an adjacent sprinkler prevents proper activation of the adjacent sprinkler. With vertical barriers, there is little to no structure to prevent spray from one sprinkler impacting an adjacent sprinkler. This 70 psi. per sprinkler maximum operating pressure limit places a hydraulic design on the overall system that can add complexity to a system that may be large in which higher pressure in the piping system may be required to ensure proper pressure delivery at hydraulic remote sprinklers. Accordingly, there is a need for higher per sprinkler maximum operating pressures and/or maximum operating pressures limits that are independent of window construction.

Disclosure of Invention

Preferred systems and methods of window fire protection include a preferred horizontal sidewall window sprinkler capable of providing water on the surface of a window to limit the transmission of heat from a fire to the glazing material and maintain the integrity of the window. The preferred embodiments of the horizontal sidewall window sprinkler define a maximum operating pressure of at least 100 psi. per sprinkler and more preferably up to 175 psi per sprinkler, at a minimum sprinkler-to-sprinkler spacing, independent of the window arrangement construction. More preferably, preferred embodiments of the horizontal sidewall window sprinkler and systems provide for higher operating pressures per sprinkler than was previously available for protection of window arrangements without vertical barriers or mullions joining the vertically abutting windows. For such a window arrangement, preferred embodiments of the sprinkler define a maximum operating of at least 100 psi., and more preferably 175 psi., at a sprinkler-to-sprinkler spacing as small as six feet. For window arrangements in which the windows are vertically joined to one another by vertically extending mullions or barriers, the preferred sprinkler defines a maximum operating pressure of 175 psi.

The preferred embodiments of the horizontal sidewall window sprinkler include a fluid deflection member geometry to facilitate window fire protection system installations with a maximum operating pressure for window arrangement constructions not previously available. The preferred fluid deflection member geometry is defined by one or more of the following features: a perimeter with a variable radius and/or a surface with one or more discontinuities. In preferred embodiments of the sprinkler, the preferred fluid deflection member includes a face for confronting a window that is asymmetrical with respect to a first plane. The face is also bisected and symmetrical with respect to a second plane that intersects and is perpendicular to the first plane at the sprinkler axis. The face preferably includes a planar portion disposed perpendicular to the first and second plane, and a concave portion defined by a constant radius of curvature having a center located along the sprinkler axis. The deflection member also includes two radially extending slots extending between the planar portion and the concave portion.

In one preferred embodiment of horizontal sidewall window sprinkler includes a frame having a body with an inlet, an outlet with an internal passageway extending between the inlet and the outlet along a sprinkler axis. A preferred fluid deflection member located at a fixed distance from the outlet consists of three radially extending slots with each slot having a slot width and a maximum slot length. Two of the slots are diametrically opposed about the sprinkler axis and the third slot is centered between the two diametrically opposed slots with the third slot defining a minimum slot width that is greater than any maximum slot length of the three slots. Another preferred embodiment of the fluid deflection member includes a first planar portion disposed perpendicular to the first and second plane, and a second portion with a convex surface confronting the sprinkler outlet and a concave surface for confronting a window. The preferred deflection member includes two radially extending slots extending between the first portion and the second portion.

In a preferred embodiment of a window sprinkler system for protection of a window arrangement including a plurality of glass panes extending vertically between an upper window frame and a lower window frame with each pane having a face, the system preferably includes a firefighting fluid supply pipe; and a plurality of horizontal window sprinklers coupled to the fluid supply pipe and confronting the glass panes below the upper window frame. Each sprinkler preferably includes a frame including a body having an inlet, an outlet with an internal passageway extending between the inlet and the outlet along a sprinkler axis. A fluid deflector is coupled to the frame for distributing firefighting fluid over the face of a glass pane for wetting and cooling the glass pane to address a fire. each of the plurality of sprinklers preferably has a maximum operating pressure of at least 100 psi. independent of window arrangement construction.

An alternate embodiment of a horizontal sidewall window sprinkler includes a frame having a body having an inlet, an outlet with an internal passageway extending between the inlet and the outlet along a sprinkler axis. A fluid deflector is located at a fixed distance from the outlet. The deflector has a face for confronting a window. The face is preferably asymmetrical with respect to a first plane, bisected and symmetrical with respect to a second plane that intersects and is perpendicular to the first plane at the sprinkler axis. The face preferably includes a planar portion disposed perpendicular to the first and second planes and a concave portion defined by a constant radius of curvature having a center located along the sprinkler axis; and with two radially extending slots extending between the planar portion and the concave portion.

In yet another embodiment of a horizontal sidewall window sprinkler, the sprinkler includes a frame including a body having an inlet, an outlet with an internal passageway extending between the inlet and the outlet along a sprinkler axis and a fluid deflector located at a fixed distance from the outlet. The preferred deflector consists of three radially extending slots with each slot having a slot width and a maximum slot length, two of the slots being diametrically opposed about the sprinkler axis and the third slot being centered between the two diametrically opposed slots. The third slot defines a minimum slot width that is greater than any maximum slot length.

Preferred embodiments of a method of window fire protection are also provided. One preferred method includes obtaining a plurality of window sprinklers each having a deflector; and providing the window sprinklers for installation in a horizontal orientation with each deflector oriented to confront a glass pane and discharge fluid toward the glass pane and laterally to define a maximum operating pressure of at least 100 psi. for each of the plurality of sprinklers independent of window arrangement construction. Preferred embodiments of the method include defining a maximum operating pressure per sprinkler of 175 psi. for installation in the protection of windows separated by vertical barriers and/or in the protection of windows joined to one another by butt joints without vertical barriers therebetween.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1:
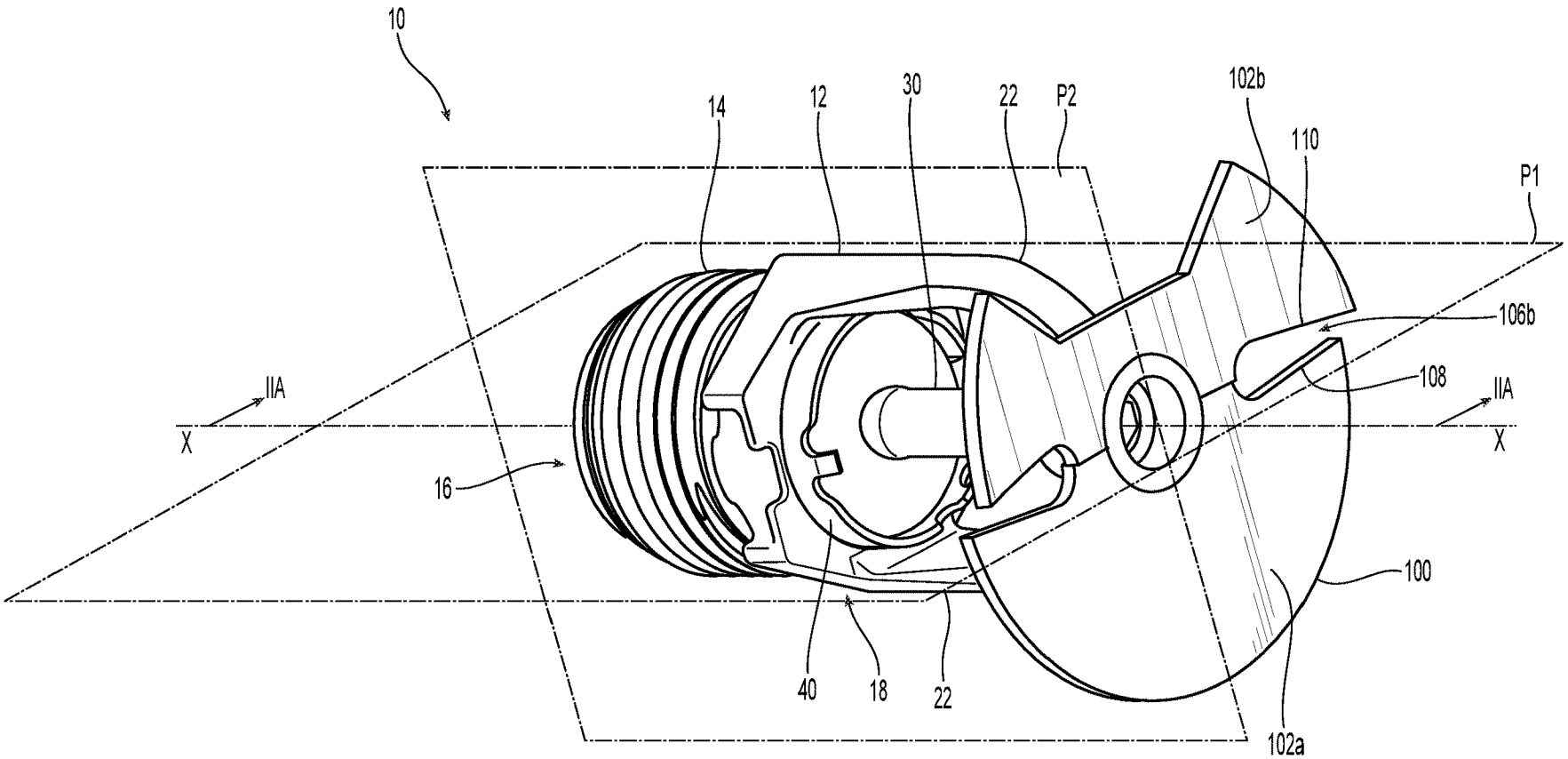
FIG. 1 is a perspective view of a preferred embodiment of a horizontal sidewall window sprinkler in an unactuated and sealed configuration.
Figure 2A:
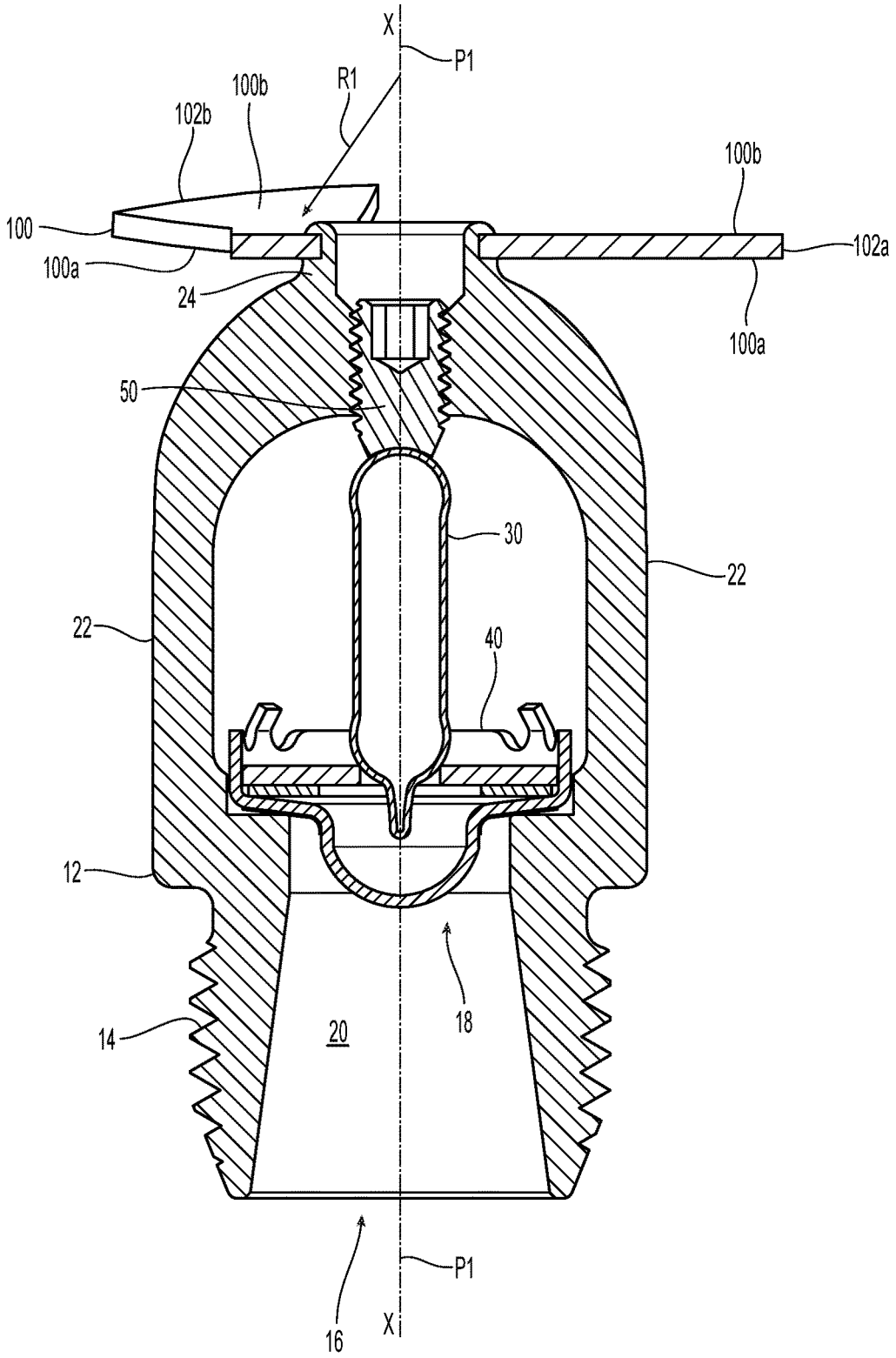
FIG. 2A is a cross-sectional view of the sprinkler of FIG. 1 in an unactuated and sealed configuration.
Figure 2B:
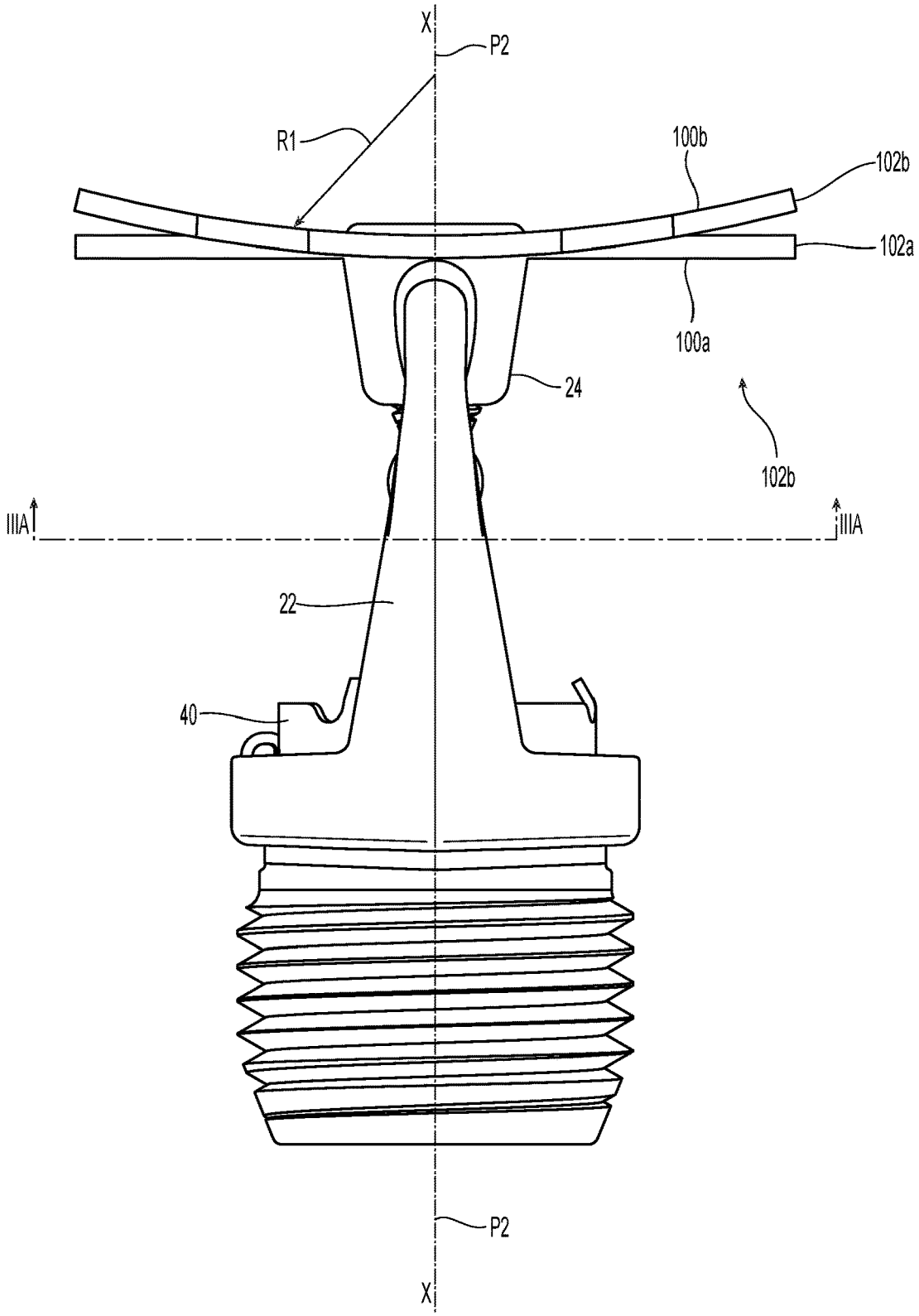
FIG. 2B is a top-side view of the sprinkler of FIG. 1 in an unactuated and sealed configuration.

Shown in FIGS. 1, 2A and 2B is a preferred horizontal sidewall window sprinkler 10 that includes a frame 12 having a body 14 with an inlet 16, an outlet 18 and an internal passageway 20 extending between the inlet 16 and the outlet 18 along a sprinkler axis X-X to define the sprinkler orifice. The internal passageway 20 preferably tapers narrowly from the inlet 16 to the outlet 18. The discharge characteristics from the sprinkler body 12 and its outlet orifice are preferably quantified by the industry accepted discharge coefficient or nominal K-factor. The sprinkler body 12 defines a nominal K-factor that is preferably less than K11 GPM/$(PSI)^{1/2}$ and is preferably a K 5.6 GPM/$(PSI)^{1/2}$ (hereinafter K5.6). Alternatively, the sprinkler body 12 can be configured with any nominal K-factor along with other preferred factors described herein to provide desired discharge characteristics.

A fluid deflection member or deflector 100 is axially spaced from the outlet 18 for distribution of a firefighting fluid. Fluid supplied to the sprinkler inlet 16 flows through the internal passageway 20 and is discharged from the outlet 18 to impact the deflection member 100 to wet and cool a window arrangement in a preferred manner as described herein. Preferred embodiments of the sprinkler 10 are configured for installation in a horizontal orientation in which the sprinkler is suspended from a fluid supply pipe with the sprinkler axis X-X generally parallel to the flat ground or floor and perpendicular to the window arrangement. With the inlet 16 coupled to the pipe and the deflector 100 aligned axially with the body 14, water discharged from the outlet 18 is discharged in the horizontal direction to impact the deflection member 100. Accordingly, the frame body 14 is preferably configured for fastening to a pipe fitting using, for example, an appropriate external pipe thread for engagement with a complimentary thread of a pipe fitting. In the preferred embodiment of the frame 12, the external thread is preferably ½-14 NPT thread. Alternatively, the external surface of the body can be configured for other forms of mechanical connection to the supply piping such as for example, grooved for a groove-type coupling or otherwise shaped for an interference fit type coupling.

The frame 12 also preferably includes a pair of spaced apart frame arms 22 extending axially from the body 14 to define a frame window in between. In the preferred frame 12, the frame arms 22 extending axially from the body and converging toward the sprinkler axis to define a frame boss 24 axially spaced from the outlet 18 to which the deflector 100 is preferably affixed. As seen in FIG. 1, the frame arms 22 are preferably spaced about a first plane P1 bisecting the sprinkler frame such that the frame arms 22 are diametrically opposed about the outlet 18 and aligned with one another in a second plane P2 that intersects and is perpendicular to the first plane P1 at the sprinkler axis X-X.

The sprinkler 10 is preferably configured as an automatic sprinkler for installation in an interior sprinkler system for protection of an internal face of a window arrangement. As seen in FIG. 2A, a thermally responsive trigger 30 is disposed within the frame window and aligned with the sprinkler axis X-X to support a seal assembly 40 within the outlet 18 to seal the sprinkler 10. In the unactuated and sealed state of the sprinkler, a load member 50 such as, for example a threaded screw engaged with the boss 24, applies a load force that is transferred by the thermally responsive trigger 30 to the seal assembly 40 to maintain the seal assembly within the outlet against incoming fluid supply pressure. The thermally responsive trigger 30 is preferably embodied as a thermally responsive frangible glass bulb but can be alternatively embodied as a thermally responsive mechanical or electrically actuated assembly provided the assembly can seat and unseat the seal assembly 30 in respective unactuated and actuated states of the sprinkler. In the presence of a sufficient level of heat, the thermally responsive element 30 operates or actuates to release the sealing assembly 40, unseal the sprinkler 10 and permit the supplied fluid to discharge from the outlet 18 to impact the fluid deflection member 100 for distributing fluid on a window. Alternatively, the sprinkler 10 can also be configured as an open sprinkler for installation in an outdoor deluge sprinkler system for protection of an exterior face of a window arrangement. In an open configuration, the sprinkler has neither a trigger nor a seal assembly disposed in the outlet 18 of the sprinkler. Thus, the sprinklers are open in the unactuated state of the system with fluid delivered to the sprinklers either manually or by an automatic thermally responsive fluid control valve arrangement. Upon the fluid delivery to the open sprinkler 10, the supplied fluid is discharged from the outlet 18 to impact the fluid deflection member 100 for distributing fluid on the exterior face of the window arrangement.

The fluid deflection member 100 is defined by a preferred geometry to provide for preferred fluid impact or deflecting surfaces that independently or in combination with the frame 12 provide the fluid distribution described herein. Generally, the preferred fluid deflector geometry is defined by a peripheral edge that borders the fluid impact or deflecting surfaces of the deflector and is defined by a variable radius with respect to the center of the deflection member. Accordingly, preferred embodiments of the deflection member 100 and its periphery are non-circular. Additionally or alternatively, the preferred fluid deflection member 100 preferably includes one or more discontinuities along its peripheral edge and/or between its peripheral edge and center. Thus, a fluid deflection member 100 in the sprinkler 10 can include one or more slots, through holes or channels through which fluid flows.

Figure 3A:
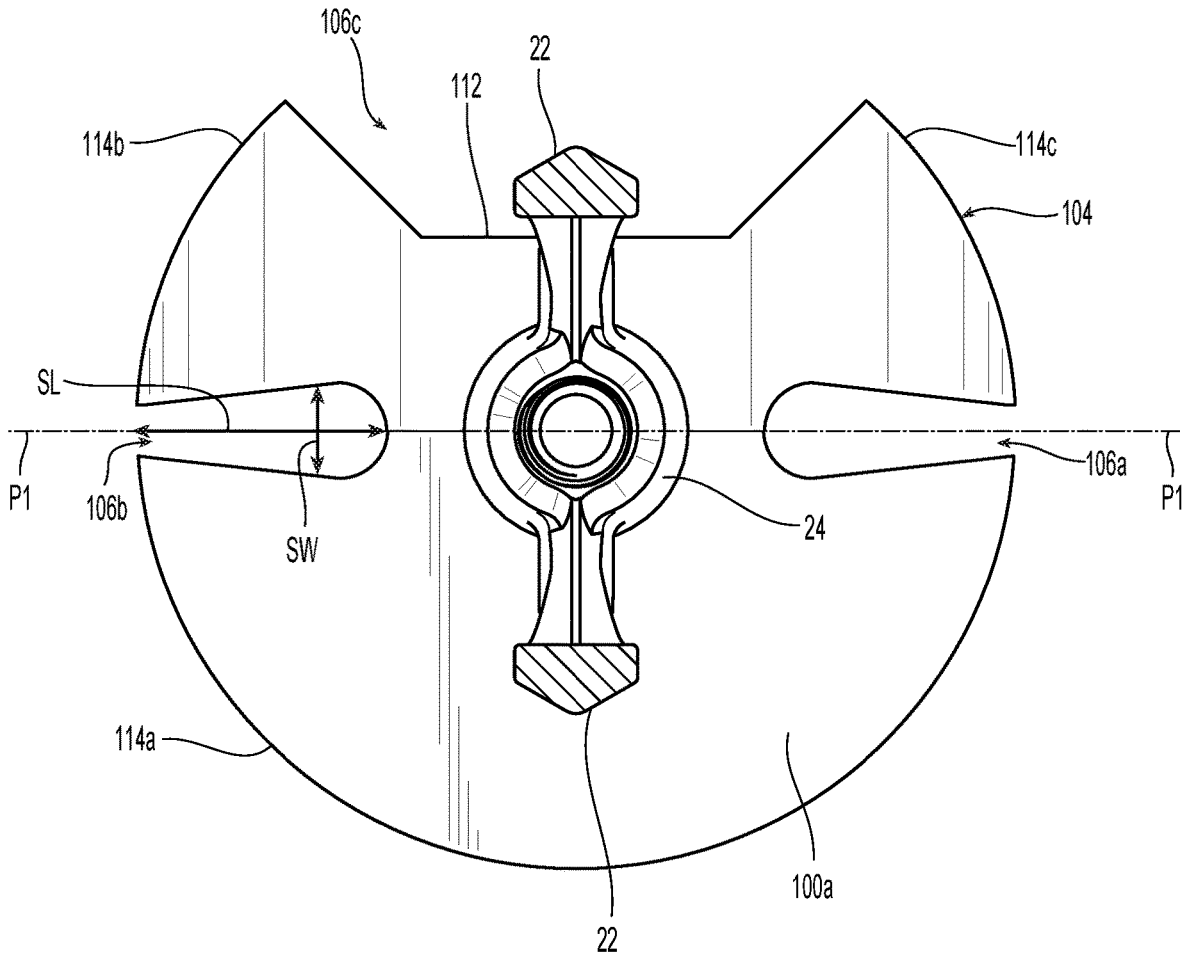
FIG. 3A is a partial cross-sectional view of the sprinkler in FIG. 2B along line IIIA-IIIA.
Figure 3B:
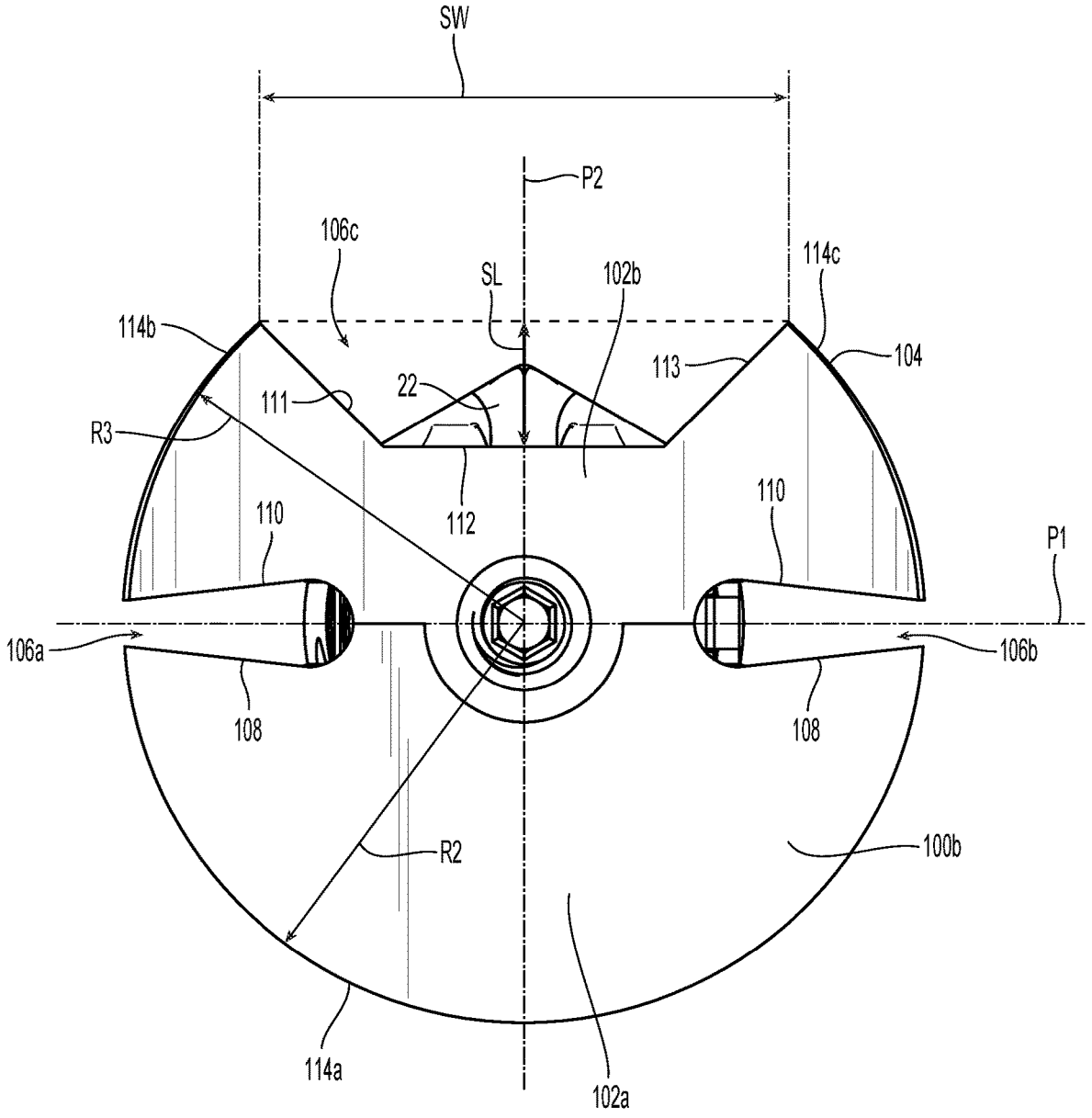
FIG. 3B is a front view of the sprinkler of FIG. 1.

Shown in FIG. 3A, the fluid deflection member 100 is preferably shaped and formed to define a first surface 100*a*, that confronts the outlet 18, in combination with the boss 24 and arms 22, to be impacted by fluid discharged from the body 14. Shown in FIG. 3B is a second surface 100*b* opposite the first surface 100*a* that confronts a glass pane or window in the installation of the sprinkler 10. The fluid deflection member 100 is oriented with respect to the frame 12 so as to be bisected and symmetrical with respect to the second plane P2 and the frame arms 22 and to be asymmetrical with respect to the first pane P1. The sprinkler 10 is shown in which the fluid deflection member 100 is preferably stamped from a circular blank and formed accordingly into one of the preferably non-circular fluid deflection members described herein. Alternatively, the sprinkler and deflection member 100 can be formed by casting and appropriate machining. Further in the alternative, the fluid deflection member 100 can be formed by separate components or elements which are joined to provide for the preferred fluid deflecting surfaces that independently or in combination with the frame 12 provide the fluid distribution described herein.

With reference to FIGS. 2A and 2B, the deflector 100 defines a first deflector portion 102*a* and a second deflector portion 102*b* that is different than the first deflector portion 102*a* with respect to the first plane P1. The first deflector portion 102*a* is preferably a planar flat member portion with each of the opposed parallels surfaces 100*a*, 100*b* of the first deflector portion disposed perpendicular to the first and second planes P1, P2. The second deflector portion 102*b* is out of plane with respect to the first deflector portion 102*a* such that the first surface 100*a* of the second deflector portion 102*b* defines a preferably convex surface with respect to the outlet 18 and the second surface 100*b* of the second deflector portion 102*b* defines a preferably concave window confronting surface. More preferably, the opposed convex and concave surfaces of the second portion 102*b* are parallel to one another defined by constant radii of curvatures. As shown, the window confronting surface 100*b* of the second portion 102*b* has a constant radius of curvature R1 with a center located along the sprinkler axis X-X.

With reference to FIGS. 3A and 3B, the deflector 100 includes a peripheral edge 104 surrounding the sprinkler X-X at a variable radius to define the perimeters of the varied deflector portions 102*a*, 102*b*. Moreover, the peripheral edge 104 defines a preferred plurality of channels or slots through which fluid can flow for distribution in a desired manner. One or more of the slots extends preferably radially toward the sprinkler axis X-X and is defined by a slot length SL that at its maximum extends from the slot opening at the radially outer most portion of the perimeter 104 to the inner most portion of the slot defined at a radially inward portion of the perimeter 104 from the slot opening. The slots are also defined by a slot width SW that is measured perpendicular to the slot length SL as the distance between two sidewalls that extend from the slot opening to the slot inner most portion. As described herein, the slot widths SW of the slots preferably vary over the slot lengths SL of the slots. Alternatively, the slot widths can be constant over the slot length.

In the embodiment shown in FIGS. 3A and 3B, the deflector includes and more preferably consists of three radially extending slots 106*a*, 106*b* and 106*c*. The fluid deflector 100 preferably includes a pair of radially extending slots 106*a*, 106*b* diametrically opposed about the frame boss 24 and respectively bisected by the first plane P1. Each of the diametrically opposed slots 106*a*, 106 are preferably asymmetric with respect to the first plane P1. In the embodiment shown, the opposed slots 106*a*, 106*b* at least partially space apart the two portions 102*a*, 102*b* of the deflector 100. Moreover, the spaced apart sidewalls forming the slots 106*a*, 106*b* are preferably defined by portions of the peripheral edge 104 respectively extending along the first and second portions 102*a*, 102*b* of the deflector 100. Thus for example, with reference to FIG. 1 or 3B, the asymmetrical radially extending slots 106*a*, 106*b* are each defined by a first sidewall 108 of planar portion 102*a* of deflector 100 and a second sidewall 110 of the concave portion 102*a*. Accordingly, between the first and second deflector portions 102*a*, 102*b* there is a preferred surface discontinuity in the deflector 100 defined by the radially extending slots 106*a*, 106*b*. Preferably, the sidewalls 108, 110 of each slot 106*a*, 106*b* diverge away from one another in the radial direction from the slot opening toward the sprinkler axis X-X so that each slot broadens in the direction from the slot opening at the periphery of the deflector toward the sprinkler axis X-X. Each of the sidewalls 108, 110 also preferably terminate at a radial inner portion of the deflector peripheral edge 104 to define the inner most portion of each slot. For each of the opposed slots 106*a*, 106*b*, the slots terminate at a radiused portion of the peripheral edge 104 to define the radially innermost portion of each slot 106*a*, 106*b*. In a preferred embodiment of the deflector 100, each of the opposed slots 106*a*, 106*b* define a slot length SL of 0.5 inch with a slot width ranging from a minimum at the slot opening of 0.125 inch to a maximum proximate the radiused innermost portion of 0.18 inch. Accordingly, the diametrically opposed slots 106*a*, 106*b* preferably broaden in the radial direction toward the sprinkler axis X-X.

A preferred third radially extending slot 106*c*, is formed along the peripheral edge of the 104 of the second portion 102*b* of the deflector 100 as seen in FIG. 3B. Moreover, the third slot 106*c* is formed and located so as to be bisected by and symmetrical with respect to the second plane P2. The third slot 106*c* is defined by a preferred planar edge portion 112 of the peripheral edge 104 of the deflector 100 that preferably extends parallel to with respect to the first plane P1 and is curved with respect to the second plane P2. The edge portion 112 defines the innermost portion of the third slot 106*c*; and two preferably linear portions of the peripheral edge 104 extend from each end the planar edge portion 112 to define the respective sidewalls 111, 113 of the slot 106*c*. In a preferred aspect of the window confronting surface 100*b*, as seen in FIG. 3B, the slot 106*c* presents to a protected window a pair of slot sidewalls 111, 113 that extend away from one another at a skewed angle, and more preferably extending at a forty-five degree (45° angle, with respect to the inner linear edge 112. Accordingly, the slot width SW of the third slot 106*c* preferably varies over its slot length SL. Unlike the diametrically opposed slots 106*a*, 160*b*, the third slot preferably narrows in the radial direction toward the sprinkler axis X-X. Moreover, the slot length SL of the third slot 106*c* is preferably less than the slot width SW and thus less than the linear length of the inner planar edge 112. In a preferred embodiment of the deflector 100, the third slot 106*c* defines a maximum slot length SL which preferably ranges from 0.18-0.2 inch with a slot width ranging from a maximum width at the slot opening of about one inch (1 in.) (1 in.-1.1 in.) to a minimum at the inner linear edge 112 of about 0.7 inch (0.675 in.-0.725 in). Accordingly, the inner planar edge 112 defines a preferred length that is greater than the slot length of the radially extending diametrically opposed slots 106*a*, 106*b*. In a preferred aspect, the linear planar edge 112 and the opposed slots 106*a*, 106*b* defines a ratio of edge length-to-maximum slot length SL that ranges from 1.4:1 to 1.5:1.

In addition to defining the various slot geometries, the peripheral edge 104 of the deflector 100 defines the radial outermost periphery of the deflector 100 that extends between slot openings. These portions of the peripheral edge can be linear, arcuate or a combination thereof provided the deflector 100 distributes fluid in a preferred manner as described herein. More preferably, the peripheral edge 104 includes and more preferably consists of three arcuate portions that extend between the slots 106*a*, 106*b*, 106*c*. In the preferred embodiment of the deflector shown in FIG. 3B, the peripheral edge 104 along the first portion 102*a* of the deflector defines a first arc length portion 114*a* that continuously extends from one of the pair of diametrically opposed slots 106*a* to the other 106*b*. The first arc length portion 114*a* is preferably defined by a radius of curvature R2 that is centered at the sprinkler axis X-X and constant over the entire first arc length portion 114*a*. The peripheral edge 104 along the second portion 102*b* preferably includes a second arc length portion 114*b* and a third arc length portion 114*c* spaced apart from one another by the opening to the third radially extending slot 106*c* with the preferred planar edge portion 112 centered in between the second and third arc portions 114*b*, 114*c*. The second arc length portion 114*b* preferably extends continuously between the first and third slots 106*a*, 106*c* and is preferably defined a third radius of curvature R3 and the first radius of curvature R1 (FIG. 2B) defining the concave portion of the window confronting surface 100*b*. The third radius of curvature is preferably constant with its center along the sprinkler axis X-X. Preferably similarly, the third arc length portion 114*c* preferably extends continuously between the second and third slots 106*b*, 106*c* and is defined by the preferably constant radius of curvature R3 and the first radius of curvature RE In preferred embodiments of the deflector 100, each of the second and third radii of curvatures R2, R3 defines a radius of 0.75 inch. Accordingly, in a preferred aspect, the planar edge portion 112 at the innermost portion of the third radial slot 106*c* defines a length smaller than the radii of curvatures R2, R3 of the arc length portions 114*a*, 114*b*, 114*c*. Moreover, the planar edge 112 is preferably located at a distance from the first plane P1 that is less than the constant radius of curvature R2 of the first arc length portion 114*a*.

Figure 4A:
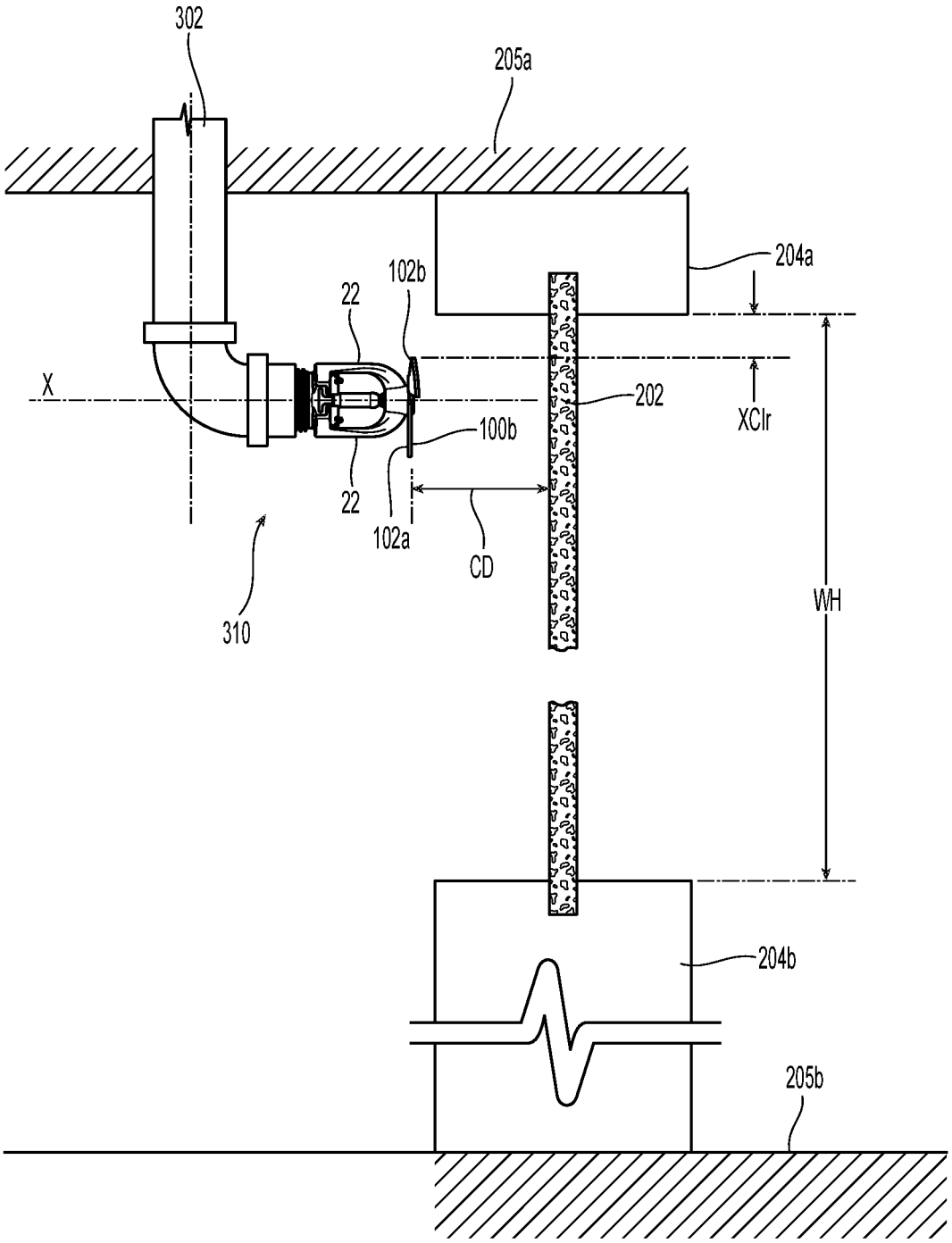
FIGS. 4A-4B are side and elevation schematic views of a preferred window fire protection system using the sprinkler of FIG. 1.
Figure 4B:
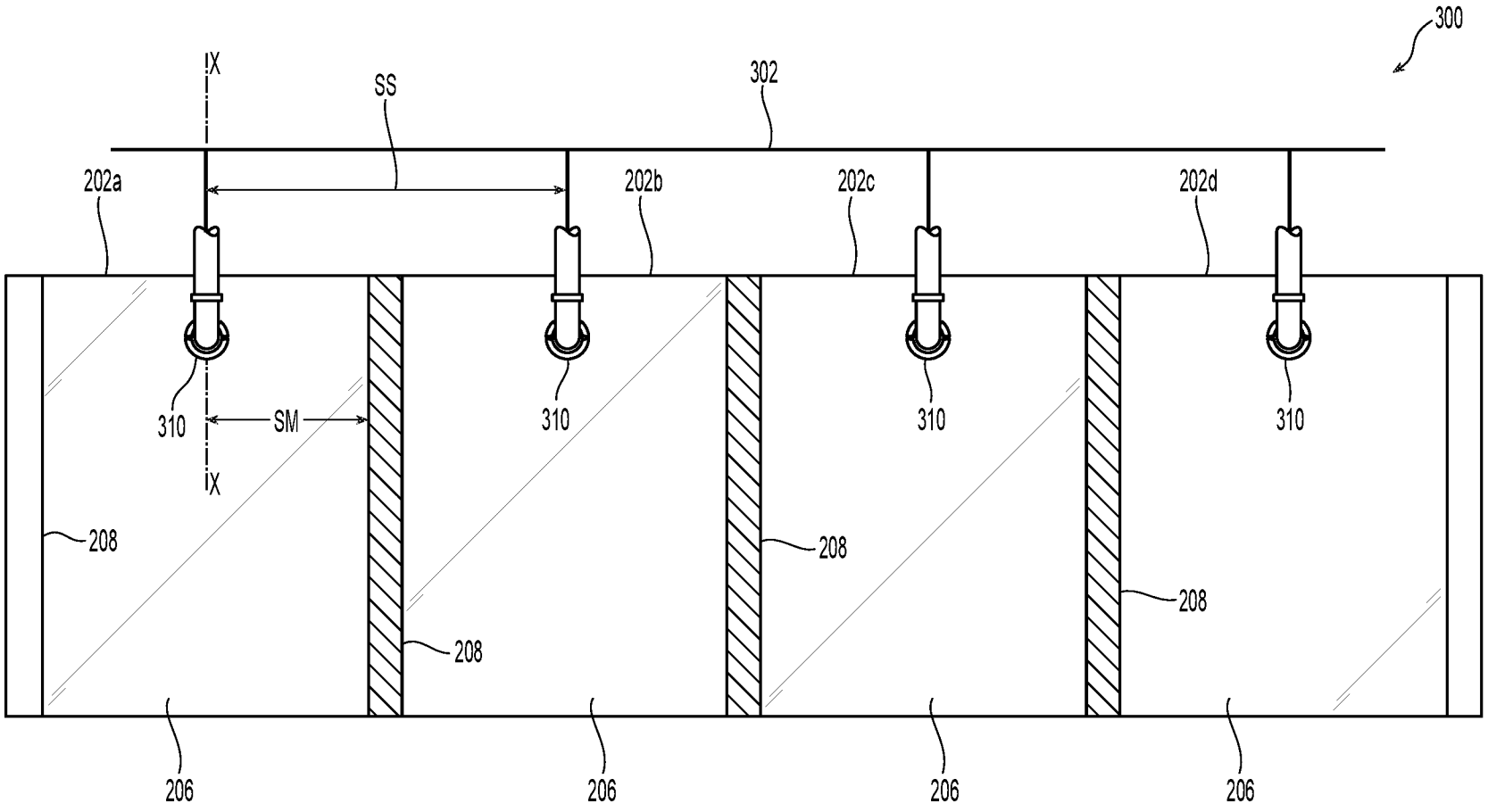

Preferred embodiments of the window sprinkler can be installed in a fire protection sprinkler system for protection of a window arrangement located along the exterior of a building or within an interior room of the building. As seen in FIGS. 4A and 4B, an illustrative window arrangement 200 includes a plurality of glass panes 202*a*, 202*b*, 202*c*, 202*d* (202 collectively). The glass panes 202 are preferably constructed as a non-operable glass type with a heat-strengthened and tempered treatment. The glass pane 202 has a preferred ¼ inch thickness with a glazing that is either single-glazed/single pane, double-glazed/double pane or insulated. Each of the window panes 202 extend vertically between an upper window frame 204*a* and a lower window frame 204*b* spaced apart from one another to define a maximum window height WH of up to a preferred thirteen feet (13 ft.). The upper frame 204*a* can be anchored to an overhead building structure 205*a*, such as for example, a ceiling, which can be a recessed ceiling, or overhang. The lower frame 204*b* is anchored to a lower building structure 205*b* such as, for example, a floor or a wall rising from the floor 205*b*. In the elevation view shown in FIG. 4B, each of the glass panes 202 present a face 206. The glass panes 202 are shown separated from one another by vertical barriers or mullions 208 extending between the upper and lower window frames 204*a*, 204*b*. Alternatively, the glass panes 206 can abut one another with a butt joint (not shown) formed in between the glass panes 202 using an appropriate sealant such as, for example, a silicone sealant.

A preferred automatic window fire protection system 300 includes a firefighting fluid supply pipe or branch line 302 disposed in the overhead ceiling 205*a* or structure above the window arrangement 200. A group of preferred horizontal window sprinklers 310 is coupled to the fluid supply pipe 302 in a manner that orients the sprinklers 310 to confront the glass panes 202 below the upper window frame 205*a* at a preferred distance of one to two inches (1-2 in.) below the frame 205*a*. As seen in FIGS. 4A and 4B, the sprinklers 310 are installed and oriented with the curved second portion 102*b* of the deflector above the planar first portion 102*a* with the window confronting surface 100*b* at a preferred confronting distance CD from the glass pane 202 that preferably ranges from one-half inches to four inches (½ in.-4 in.). The sprinklers 310 are preferably located vertically below the upper frame 204*a* to define a clearance distance XClr that preferably ranges from one to three inches (1 in.-3 in.) in between the upper frame 204*a* and the curved second portion 102*b* of the deflector 100 and more preferably between the upper frame 204*a* and the planar edge 112 of the second portion 102*b*. The sprinklers 310 are preferably oriented horizontally with their axes X-X perpendicular with respect to the glass pane 202. Moreover, each sprinkler 310 is oriented with the frame arms 22 in a vertical relationship with one frame arm 22 disposed above the other frame arm 22 and each of the frame arms 22 extending axially generally parallel to the floor 205*b*.

More preferably, the sprinklers 310 are horizontally centered with respect to each glass pane 202 to define a sprinkler-to-sprinkler spacing SS from one another as seen in FIG. 4B. The preferred sprinklers 310 are configured in a manner as previously described including having a fluid deflection member embodied as previously described for distributing firefighting fluid over the face 206 of a glass pane 202 to define a preferred sprinkler-to-sprinkler spacing SS that can range from a minimum six feet to a maximum 15 feet (6-15 ft.) preferably ranging from a minimum six feet to a maximum eight feet (6-8 ft.). In one or more preferred system embodiments, the maximum sprinkler-to-sprinkler spacing SS is eight feet (8 ft.). Alternate embodiments could provide for sprinkler-to-sprinkler spacing ranging from over eight feet to fifteen feet (8+-15 ft.). Where applicable, each sprinkler 310 is preferably spaced from the nearest vertical mullions 208 at a preferred sprinkler-to-mullion distance SM that ranges from a minimum of four inches to a maximum of seven feet (⅓ ft. to 7 ft.) and more preferably ranges from a minimum of four inches to a maximum of five feet (⅓ ft. to 5 ft.).

The system 300 is preferably hydraulically configured to supply at least a minimum flow of firefighting fluid, i.e., water, to each window sprinkler 310 depending upon the sprinkler-to-sprinkler spacing SS. Preferably, each window sprinkler 310 is provided with a minimum flow of fifteen to twenty gallons per minute (15-20 GPM) and more preferably provided with a minimum flow of twenty gallons per minute (20 GPM) when the sprinklers 310 are at the preferred maximum sprinkler-to-sprinkler spacing SS. In one preferred embodiment, each window sprinkler 310 is provided with a minimum flow of twenty gallons per minute (20 GPM) when the sprinklers 310 are at the preferred sprinkler-to-sprinkler spacing SS ranging from six to eight feet (6 ft.-8 ft.). The flow of each sprinkler 310 can be reduced with a reduction in the sprinkler-to-sprinkler spacing SS. Accordingly, another preferred embodiment, each window sprinkler 310 is provided with a minimum flow of fifteen gallons per minute (15 GPM) when the sprinklers 310 are at a sprinkler-to-sprinkler spacing SS of less than six feet (6 ft.).

Moreover, a preferred system 300 is preferably configured to provide a maximum operating pressure of firefighting fluid to each sprinkler 310 independent of window arrangement construction. More specifically, the preferred body 14 and deflector 110 of each sprinkler 310 define a preferred maximum operating pressure of at least 100 psi. and preferably no more than 175 psi. in the absence of vertical barriers or baffling in the window arrangement being protected. In an alternate window arrangement in which adjacent windows are separated by a vertical barrier or mullion, the maximum operating pressure provided to each sprinkler is preferably no more than 175 psi. In another preferred embodiment of the system 300 in the protection of a window arrangement in which adjacent windows abut one another with an appropriate butt joint, using an appropriate sealant such as, for example, a silicone sealant, the maximum operating pressure provided to each sprinkler is 175 psi. In yet another preferred embodiment of the system 300 in the protection of a window arrangement in which adjacent windows are separated by a vertical barrier or mullion, the maximum operating pressure provided to each sprinkler is 175 psi.

The maximum operating pressure for each sprinkler defines a limit at which sprinklers can be placed adjacent to one another without the concern of cold soldering regardless of whether there is a vertical barrier separating adjacent windows. By providing a maximum operating pressure per sprinkler of 100 psi., the system 300 can be constructed without concern for providing lower pressures at low sprinkler-to-sprinkler spacings or in constructions without vertical barriers between windows. Preferred embodiments of the sprinkler described herein were tested in a cold soldering test to verify proper thermal operation of adjacent sprinklers provided with the 100 psi. of operating fluid pressure. Two or more preferred sprinklers as described above were spaced apart from one another at a sprinkler to sprinkler spacing of no more than six feet (6 ft.) within a test room. The test sprinklers were connected to test piping to supply the test sprinklers with water at an operating fluid pressure of 100 psi. A test fire was ignited with the test fire being sufficient in size and temperature, to thermally actuate one or more of the test sprinklers. The time to thermal actuation of each sprinkler was monitored along with the temperature of the test window and surrounding frame. The test sprinklers satisfactorily performed with no cold soldering resulting as adjacent test sprinklers thermally actuated as expected.

Preferred embodiments of the fluid deflection member and satisfactory cold soldering testing provide for preferred methods of fire protection. In a preferred embodiment method of window fire protection, the method includes obtaining a plurality of window sprinklers each having a deflector; and providing the window sprinklers for installation in a horizontal orientation with each deflector oriented to confront a glass pane and discharge fluid toward the glass pane and laterally to define a maximum operating pressure of at least 100 psi. for each of the plurality of sprinklers independent of window arrangement construction. Obtaining a preferred sprinkler can include any one of manufacturing or acquiring the preferred sprinklers; and providing such sprinklers can further include any one of selling, specifying, testing or supplying the preferred sprinklers for installation in a preferred manner as described herein. Providing the horizontal window sprinklers can also preferably include satisfactorily testing at least two of the window sprinklers in a cold soldering test with a fluid supply pressure of at least 100 psi.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A horizontal sidewall window sprinkler comprising:

a frame including a body having an inlet, an outlet with an internal passageway extending between the inlet and the outlet along a sprinkler axis, the frame including a pair of frame arms spaced about a first plane bisecting the sprinkler frame, the frame arms being diametrically opposed about the outlet so as to be aligned in a second plane that intersects and is perpendicular to the first plane at the sprinkler axis, the frame arms extending axially from the body and converging toward the sprinkler axis to define a frame boss axially spaced from the outlet; and a fluid deflector coupled to the frame boss at fixed distance from the outlet and oriented so as to be bisected and symmetrical with respect to the second plane and asymmetrical with respect to the first plane to define a first deflector portion and a second deflector portion different than the first deflector portion, the fluid deflector including:

a pair of radially extending slots diametrically opposed about the frame boss and bisected by the first plane;

the first portion of the fluid deflector includes a first peripheral edge having a first arc length portion extending from one of the pair of diametrically opposed slots to the other, the first peripheral edge being defined by a radius of curvature that is centered at the sprinkler axis and constant over the first arc length portion, the first peripheral edge defining a first constant radius over the first arc length portion;

the second portion of the fluid deflector includes a second peripheral edge having a second arc length portion extending from one of the pair of diametrically opposed slots, the second peripheral edge having a third arc length portion spaced apart from the second arc length portion with a planar edge extending between the second and third arc length portions, the planar edge being centered about the second plane and parallel to the first plane, the planar edge being located at a distance from the first plane that is less than the first constant radius of curvature of the first peripheral edge, and the second portion of the fluid deflector and the planar edge defining a third radially extending slot of the fluid deflector bisected by the second plane, the third radially extending slot having a slot width and a slot length with the slot length less than the slot width, each of the pair of radially extending diametrically opposed slots having a slot width and a slot length, the slot width of the third radially extending slot being greater than the slot length in each pair of the radially extending diametrically opposed slots.

2. The sprinkler of claim 1, wherein the first portion defines a first window confronting surface, the first window confronting surface being perpendicular to each of the first and second planes.

3. The sprinkler of claim 2, wherein the second portion defines a second window confronting surface, the second window confronting surface being concave to confront a window and defined by a radius of curvature with a center along the sprinkler axis spaced axially from the fluid deflector.

4. The sprinkler of claim 3, wherein each of the radially extending slots in the pair of radially extending slots are asymmetrical, each slot having a pair of spaced apart sidewalls with one sidewall defined by the first portion of the fluid deflector and the other sidewall defined by the second portion of the fluid deflector.

5. The sprinkler of claim 4, wherein the pair of sidewalls angle away from one another about the first plane in a radial direction toward the sprinkler axis.

6. The sprinkler of claim 1, wherein the pair of radially extending slots broaden in a direction toward the sprinkler axis.

7. The sprinkler of claim 1, wherein the planar edge defines a radially innermost portion of the third radially extending slot, the third radially extending slot including a pair of spaced apart sidewalls that extend from the planar edge to one of the second and third arc length portions of the second peripheral edge.

8. The sprinkler of claim 1, wherein the planar edge and each of the pair of diametrically opposed radially extending slot defines a ratio of linear length-to-maximum slot length that ranges from 1.4:1 to 1.5:1.

9. The sprinkler of claim 1, wherein the planar edge and the pair of diametrically opposed radially extending slots define a ratio of linear length- to-maximum slot length that ranges from 1.4:1 to 1.5:1.

10. A window sprinkler system for protection of a window arrangement including a plurality of glass panes extending vertically between an upper window frame and a lower window frame, the plurality of glass panes having a face, the system comprising:

a firefighting fluid supply pipe; and a plurality of horizontal window sprinklers coupled to the fluid supply pipe and confronting the glass panes below the upper window frame, each sprinkler including:

a frame including a body having an inlet, an outlet with an internal passageway extending between the inlet and the outlet along a sprinkler axis; and a fluid deflector coupled to the frame for distributing firefighting fluid over the face of a glass pane for wetting and cooling the glass pane to address a fire, the fluid deflector having at least one of: (i) a periphery defining a variable radius from a center of the deflector;

(ii) a surface discontinuity; or (iii) an asymmetric geometry about one or more bisecting planes, each of the plurality of sprinklers having a maximum operating pressure of at least 100 psi. independent of window arrangement construction.

11. The system of claim 10, wherein the maximum operating pressure of each sprinkler in the plurality of horizontal window sprinklers is 175 psi. for a window arrangement in which the adjacent windows abut one another and the maximum operating pressure is 175 psi. for a window arrangement in which adjacent windows are separated by a vertical barrier.

12. A horizontal sidewall window sprinkler comprising:

a frame including a body having an inlet, an outlet with an internal passageway extending between the inlet and the outlet along a sprinkler axis; and a fluid deflector located at a fixed distance from the outlet having a face for confronting a window, the fluid deflector consisting of three radially extending slots with each slot having a slot width and a maximum slot length, two of the slots being diametrically opposed about the sprinkler axis and the third slot being centered between the two diametrically opposed slots, the third slot defining a minimum slot width that is greater than any maximum slot length, the fluid deflector including: (i) a surface discontinuity; and (ii) an asymmetric geometry about one or more bisecting planes.

13. The sprinkler of claim 12, wherein the deflector is asymmetrical with respect to a plane extending along the two diametrically opposed slots with a first planar portion and second concave portion, the third slot being formed in the concave portion.

14. The sprinkler of claim 12, wherein the deflector is symmetric about a pair of spaced apart frame arms diametrically opposed about the outlet, the frame arms converging toward the sprinkler axis to form an apex, the deflector being affixed to the apex at a fixed distance from the outlet.

15. The sprinkler of claim 12, wherein each of the two diametrically opposed slots are asymmetrical, each slot having a pair of spaced apart sidewalls with one sidewall defined by a concave portion of the fluid deflector and the other sidewall defined by a planar portion of the fluid deflector.

16. The sprinkler of claim 15, wherein the pair of sidewalls angle away from one another about the first plane in a radial direction toward the sprinkler axis.

17. A horizontal sidewall window sprinkler comprising:

a frame including a body having an inlet, an outlet with an internal passageway extending between the inlet and the outlet along a sprinkler axis; and a fluid deflector located at a fixed distance from the outlet having a face for confronting a window, the fluid deflector consisting of three radially extending slots with each slot having a slot width and a maximum slot length, two of the slots being diametrically opposed about the sprinkler axis and the third slot being centered between the two diametrically opposed slots, the third slot defining a minimum slot width that is greater than any maximum slot length, wherein the two diametrically opposed slots broaden in a direction toward the sprinkler axis.

* * * * *